US010030395B2

(12) United States Patent
Fountain

(10) Patent No.: US 10,030,395 B2
(45) **Date of Patent: *Jul. 24, 2018**

(54) FASTENING MEANS

(71) Applicant: Craig Warren Richard Fountain, Auckland (NZ)

(72) Inventor: Craig Warren Richard Fountain, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,892

(22) Filed: Oct. 10, 2016

(65) Prior Publication Data

US 2017/0037620 A1 Feb. 9, 2017

Related U.S. Application Data

(63) Continuation of application No. 13/647,530, filed on Oct. 9, 2012, now Pat. No. 9,580,914.

(51) Int. Cl.

| | |
|---|---|
| ***E04H 12/00*** | (2006.01) |
| ***E04F 15/02*** | (2006.01) |
| ***E04B 1/19*** | (2006.01) |
| ***E04B 5/02*** | (2006.01) |
| ***E04B 5/10*** | (2006.01) |

(52) U.S. Cl.

CPC ..... *E04F 15/02044* (2013.01); *E04B 1/1903* (2013.01); *E04B 5/023* (2013.01); *E04B 5/10* (2013.01); *E04B 2001/199* (2013.01); *E04F 2015/02094* (2013.01)

(58) Field of Classification Search

CPC ..... E04B 2001/199; E04B 5/023; E04B 5/10; E04B 1/1903

USPC ..... 52/650.3, 506.06, 506.08, 506.09, 586.1, 52/766

See application file for complete search history.

(56) References Cited

U.S. PATENT DOCUMENTS 3,125,177 A * 3/1964 Paller ..... H01M 2/1083 180/68.5
3,890,753 A * 6/1975 Johansen ..... E04B 9/247 24/336
4,178,656 A * 12/1979 MacFarlane ..... A47H 15/04 16/93 D (Continued)

FOREIGN PATENT DOCUMENTS

EP 2275613 A2 1/2011
FR 2754002 A1 4/1998

(Continued)

*Primary Examiner* — Basil S Katcheves

(74) *Attorney, Agent, or Firm* — Bio Intellectual Property Services LLC (BioIPS); O. Sam Zaghmout

(57) ABSTRACT

Fastening means, a preferred embodiment of which is shown in FIG. 2, hasajoist 1 and a locking member 5. The joist 1 has a channel and locking extensions and the locking member 5 has a base 6 and an upstand 7. The base 6 has rounded corners 10. The fastening means is formed such that when it is in use the locking member 5 can be slid into the channel and rotated therein to assume a locking position, such rotation made possible by the rounded corners 10 which, when in use, serve to prevent a rotational impasse between the joist 1 and the locking member 5. The fastening means is formed such that when the locking member is in the locking position it is in a tight fit within the channel and cannot pull out of the channel by reason of obstruction by the locking extensions.

20 Claims, 7 Drawing Sheets

(56) References Cited

U.S. PATENT DOCUMENTS

| | | | | |
|---|---|---|---|---|
| 4,212,455 | A | 7/1980 | Eckley | |
| 4,750,310 | A | 6/1988 | Holcombe | |
| 4,827,687 | A * | 5/1989 | Frawley | E04B 9/10 52/473 |
| 5,557,902 | A * | 9/1996 | Witmyer | E04B 9/10 248/317 |
| 5,944,293 | A * | 8/1999 | Loy | B64C 25/60 248/202.1 |
| 6,314,699 | B1 * | 11/2001 | West | E04B 5/023 52/177 |
| 6,418,685 | B1 * | 7/2002 | Oliver | E02D 5/801 24/199 |
| 6,594,961 | B2 * | 7/2003 | Leines | E01C 5/20 52/177 |
| 7,409,803 | B2 * | 8/2008 | Grohman | E04B 5/12 52/489.1 |
| 7,533,500 | B2 * | 5/2009 | Morton | B29C 47/0028 52/177 |
| 7,886,496 | B1 * | 2/2011 | Spransy | E04B 9/006 52/220.6 |
| 8,191,565 | B2 * | 6/2012 | Reyen | E04H 15/18 135/119 |
| 8,291,666 | B1 * | 10/2012 | Garrison | E04B 1/003 52/177 |
| 2005/0034402 | A1 * | 2/2005 | Johnson | E04B 9/003 52/506.08 |
| 2007/0130869 | A1 * | 6/2007 | Platt | E04B 9/067 52/506.08 |
| 2007/0257159 | A1 | 11/2007 | Nelson et al. | |

FOREIGN PATENT DOCUMENTS

| | | |
|---|---|---|
| GB | 1511145 | 5/1978 |
| WO | WO 2011/149371 A1 | 12/2011 |

* cited by examiner

FASTENING MEANS

CROSS-REFERENCE TO RELATED APPLICATIONS

This application is a Continuation of U.S. application Ser. No. 13/647,530, filed Oct. 9, 2012, now pending. The entire disclosure of the prior application is hereby incorporated by reference.

FIELD OF INVENTION

This invention relates to fastening means. A preferred form of the invention relates to fastening means for use in fastening building parts to one another.

BACKGROUND

It is known to fasten metallic extruded building elements to other building parts, for example to create a support structure for use with a walking surface, for example a deck or floor. It is an object of a preferred form of the invention to go at least some way towards providing such a structure, although it should be appreciated that the invention is not limited to this particular use. It is in general an object of the invention to provide a product which gives the public a useful choice.

SUMMARY OF THE INVENTION

According to one aspect of the invention there is provided fastening means, comprising a beam and a locking member, the beam having a channel and locking extensions, the locking member having a base and an upstand, the base having reduced corners, the fastening means formed such that when it is in use the locking member can be slid into the channel and rotated therein to assume a locking position, such rotation made possible by the reduced corners which, when in use, serve to prevent a rotational impasse between the beam and the locking member, the fastening means formed such that when the locking member is in the locking position it is in a tight fit within the channel and cannot pull out of the channel by reason of obstruction by the locking extensions.

Optionally the corners are generally rounded and/or are diagonally opposite one another.

Optionally the beam is a joist, bearer, batten or post.

Optionally the locking extensions comprise flanges overhanging the channel.

Optionally the channel has outwardly angled interior sides.

Optionally the upstand is generally T shaped in transverse cross section.

Optionally the base has inwardly tapered sides.

Optionally the locking member has an aperture suitable for receiving a fixing member to better secure the locking member to the beam.

Optionally the beam has a plurality of channels wherein each channel is able to receive a locking member in the same way defined above.

Optionally the beam is locked to another beam of the same type by a locking extrusion, the locking extrusion having a groove along each side, a locking extension from each of the beams arranged within one of the grooves, and a different locking extension from each of the beams arranged within the other groove.

According to a further aspect of the invention there is provided a walking surface, having a fastening means according to any one of the preceding claims, the locking member having been rotated into the locking position, a board laid onto one of the locking extensions so that part of the locking member extends into a side groove of the board, a second board arranged in the same way as the first board but on another of the locking extensions and with a different part of the locking member extending into a side grove of that board, and wherein the two boards are in close or butting parallel relationship and have the locking member between them to hold them against the beam.

Optionally a fixing member extends through the locking member to the beam to better secure the locking member to the beam.

According to a further aspect of the invention there is provided least two support beams joined to one another by a locking beam, each support beam having a channel and at least two locking flanges, the locking beam having a pair of grooves, each groove being at a different side of the locking beam, and each groove having therein two of the locking flanges wherein each of these comes from a different one of the structural beams. Preferably:

a) the channel of each support beam has outwardly angled interior sides and the locking flanges of that support beam overhang the channel.
b) the locking beam has sides angled back from the grooves.
c) each support beam has more than one channel and additional locking flanges adapted to enable connection with an additional support beam using an additional locking beam in the same way set out in claim 15.

BRIEF DESCRIPTION OF THE DRAWINGS

Some preferred forms of the invention will now be described by way of example and with reference to the accompanying images, of which.

DETAILED DESCRIPTION

Figure 1:
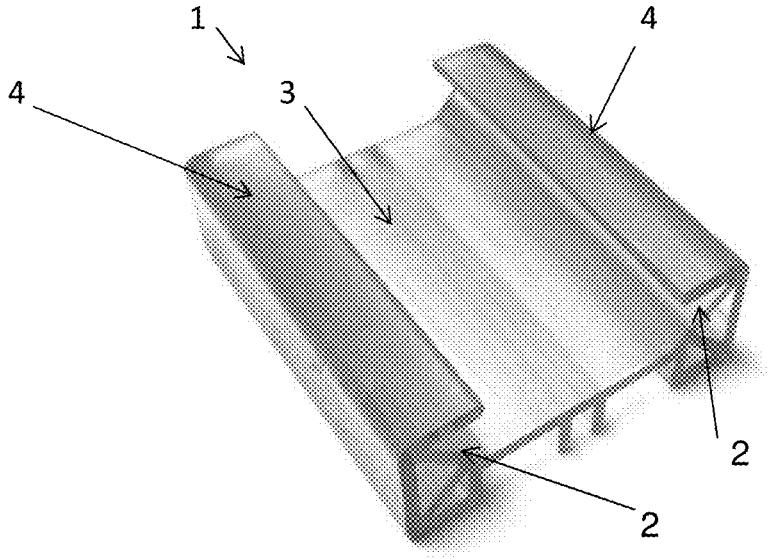
FIG. 1 is an isometric view of a section of a joist.

Referring to FIG. 1, a joist 1 in the form of a metallic extrusion is provided for use in constructing a deck. For the sake of illustration FIG. 1 only shows a short length of the joist 1 but it can of any length suitable for the project at hand. As shown, the joist 1 has interior 45° angled side walls 2 extending upwards from opposite sides of its floor 3 (although in other embodiments the side walls may be at an alternative angle or even at 90° to the floor). As also shown, the joist 1 has a pair of inwardly oriented upper flanges 4 spaced from one another and each overhanging a different one of the angled side walls 2.

Figure 2:
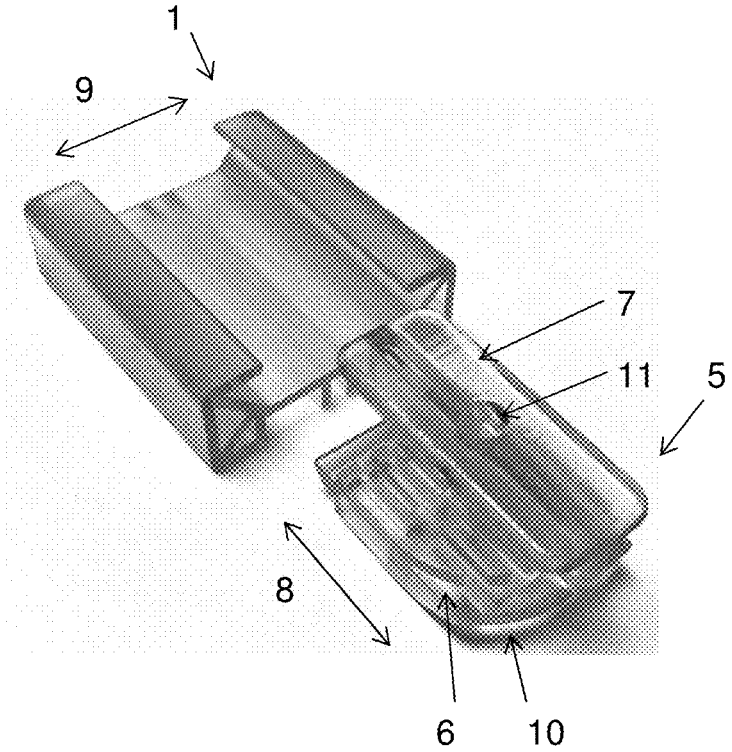
FIG. 2 is an isometric view of the joist in combination with a complimentary locking member.
Figure 3:
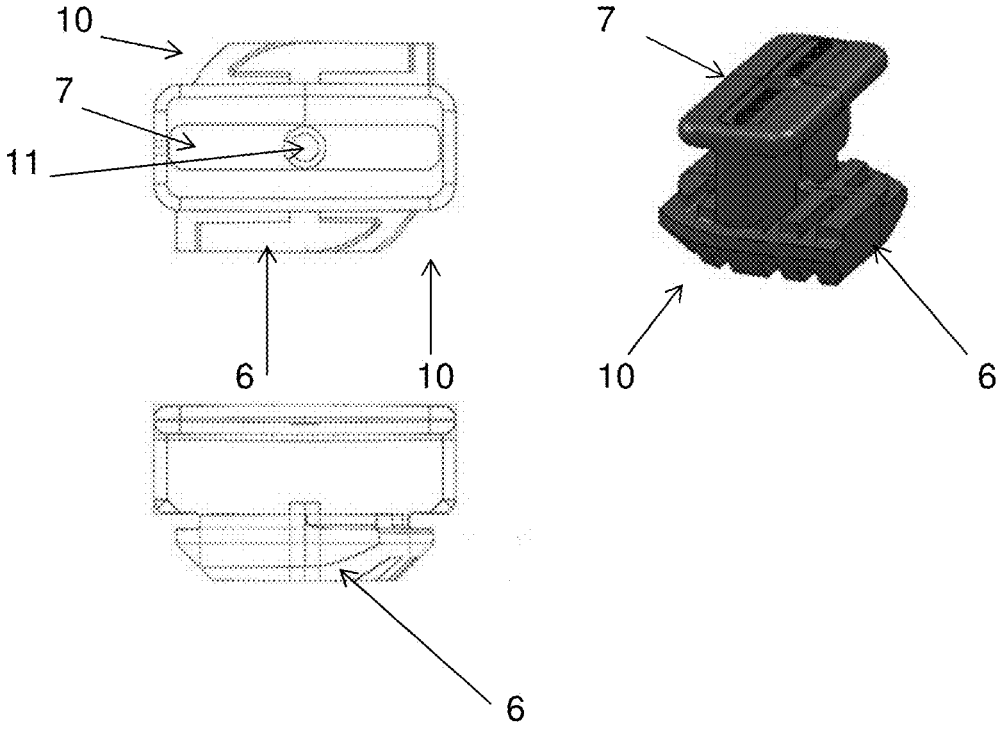
FIG. 3 shows detail of the locking member in plan, isometric and side elevation views respectively.

FIG. 2 illustrates the joist in combination with a complimentary plastic moulded locking member 5. FIG. 3 shows more detail of the locking member. Referring to these images, the locking member 5 has a base 6 and a generally "T" shaped upstand 7 (in alternative embodiments the upstand may be generally ⌐shaped in transverse cross section) The base 6 has a length 8 very slightly shorter than the inside width 9 of the joist 1. Further, the base 6 has two rounded corners 10 diagonally opposite one another.

Figure 4:
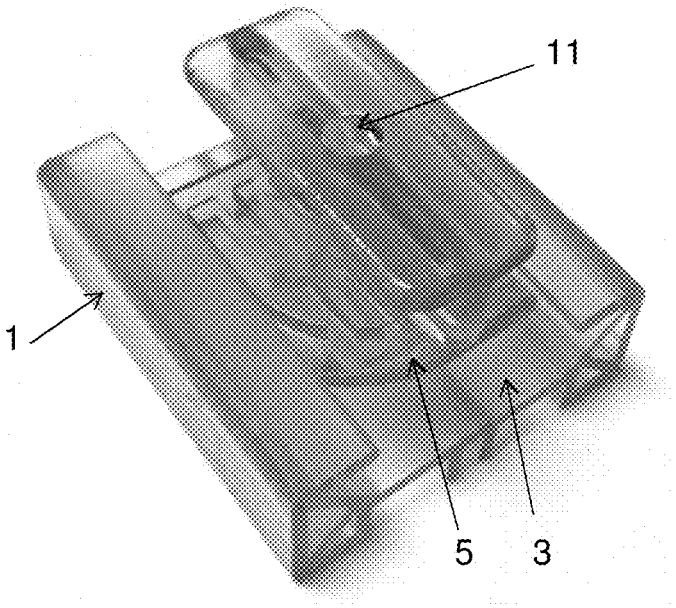
FIG. 4 provides isometric and end views of the locking member when slid into the joist.
Figure 5:
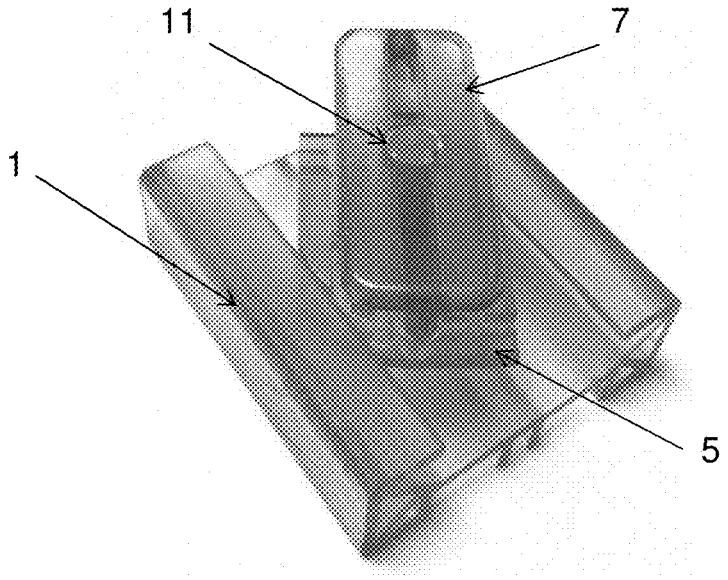
FIG. 5 is an isometric view showing the locking member when moved towards a locking position within the joist.
Figure 6:
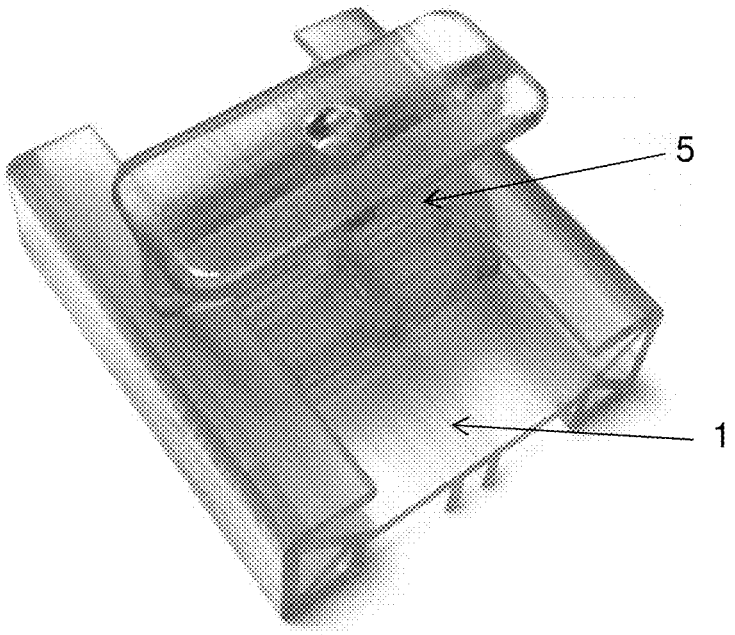
FIG. 6 illustrates the locking member in its locked position within the joist.

Referring to FIG. 4, when the locking member 5 is in use it is slid by its base 6 into the joist 1 so that the base rides across the floor 3. Referring to FIG. 5, the locking member 5 is then turned clockwise. This is possible because the base 6 has rounded corners 10, otherwise the locking member would clash with the side walls 2 and be unable to rotate as desired. In other embodiments of the invention the corners may be other than rounded, for example they may be straight line angled, however in either case the corners are suitably reduced to avoid a rotational impasse as the base rotates within the joist. The locking member 5 is turned further until it has turned 90° and is aligned at right angles to the longitudinal axis of the joist, as shown in FIG. 6. When in the FIG. 6 disposition the locking member is at least substantially locked in a tight fit with the joist. However with sufficient force some sliding movement may be possible and counter clockwise rotation would enable it to be released. To prevent these a screw or some other suitable fixing member is driven through the locking member 5 to fasten it to the joist 1. This is facilitated by a screw hole 11 formed in the locking member at the time of manufacture.

Figure 7:
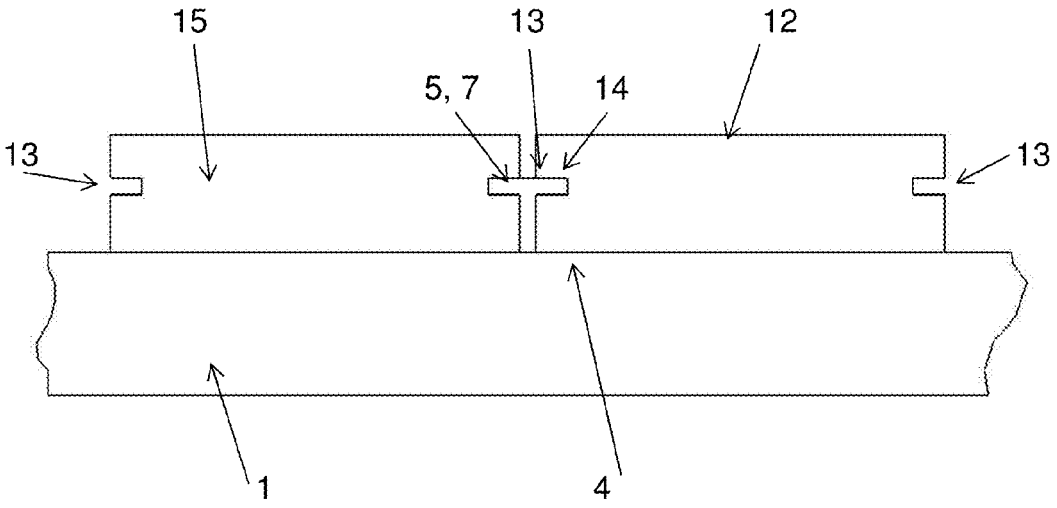
FIG. 7 is a transverse cross section view through decking boards illustrating the manner in which they are held in place by the joist and locking member.
Figure 8:
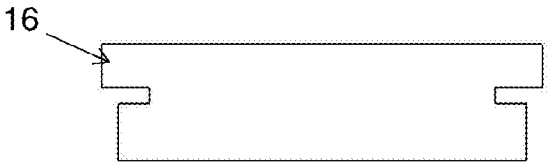
FIG. 8 is a transverse cross section of a floor board suitable for use with the joist and locking member.

Referring to FIG. 7, when the locking member 5 is in its FIG. 6 disposition a decking board 12 having grooves 13 along both its sides can be laid onto the top of one of the upper flanges 4 on one side of the locking member 5, and slid towards the locking member so that one side 14 of the upper cross piece of the T shaped upstand 7 is received within one of the board's grooves. An identical board 15 is applied to the other side of the locking member in the same way so that the two boards are held in parallel fashion against the joist. Further locking members and boards are applied in the same way until the boards provide a deck walking surface over the joist. It will be appreciated that other joists will need to be applied in the same way so as to provide proper structural support for the deck. The locking members and joists are at least substantially hidden beneath the walking surface although the boards may be very slightly spaced from one another to facilitate drainage of rain water or the like. If a closed fit is required for the boards, for example for interior flooring, the grooves may be formed with a greater upper overhang 16 as indicated in FIG. 8.

Figure 9:
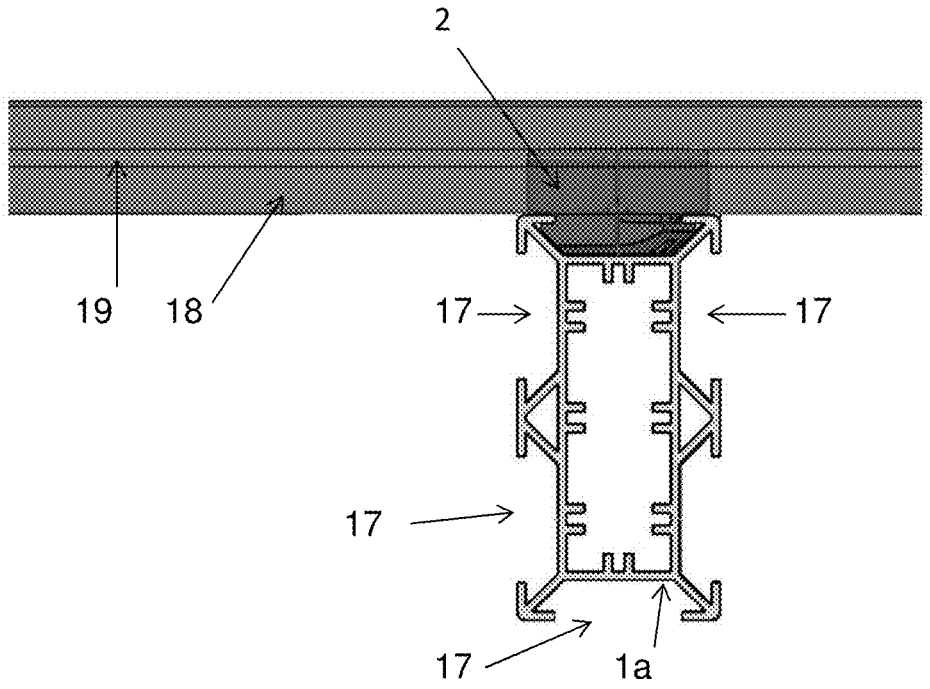
FIG. 9 is a transverse cross section view of a joist according to a further embodiment of the invention, when in use with a locking member and decking board.

FIG. 9 shows an alternative embodiment of the invention in which the single channel joist 1 is replaced by a joist 1*a* having multiple channels 17 each suitable for receiving a locking member 2. In the example shown, a decking board 18 having a groove 19 running along its side is held in place by the joist 1*a* and a locking member 2 in the channel 19. As illustrated, the joist 1*a* has a channel at each of its ends and two channels at each of its sides.

Figure 10:
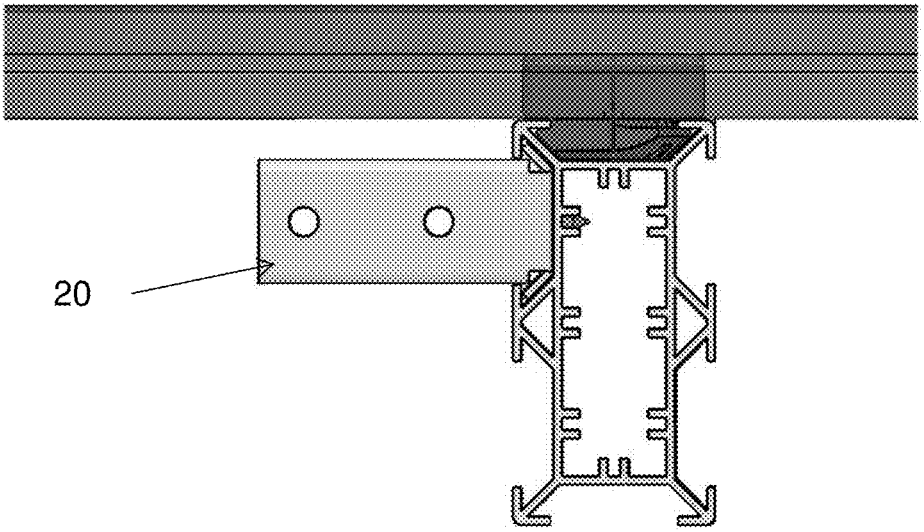
FIG. 10 shows the same arrangement as FIG. 9 but with the joist fitted with a bracket.
Figure 11:
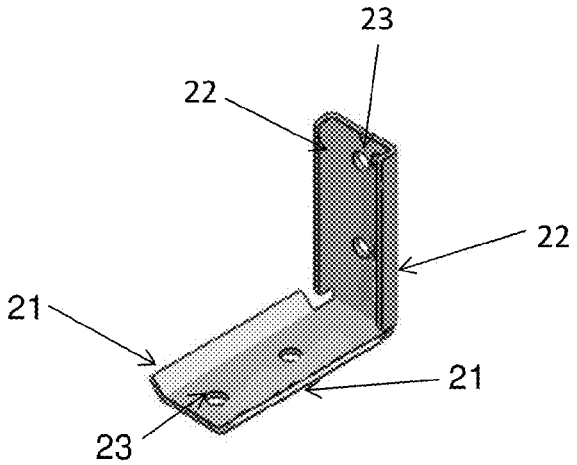
FIG. 11 is an isometric view of the bracket alone.

FIG. 10 shows the same detail as FIG. 9, except that an "L" shaped fixing bracket 20 is located in one of the channels. To facilitate this the bracket has dimensions complimentary to those of the channel. Referring to FIG. 11, the base of the bracket 20 has two wing-like upwardly angled (45°) flanges 21 and the upward part of the bracket has a pair of right angled edges 22. The maximum distance between the angled flanges 21 is greater than that of the right angled edges 22. As shown, the bracket 20 has a series of locating holes 23 to enable fastening to other building materials. The bracket 20 may thus provide a fixing point for attaching skirting boards or the like to the joist so as to hide the substructure of the deck and so provide a more aesthetically pleasing finish.

Figure 12:
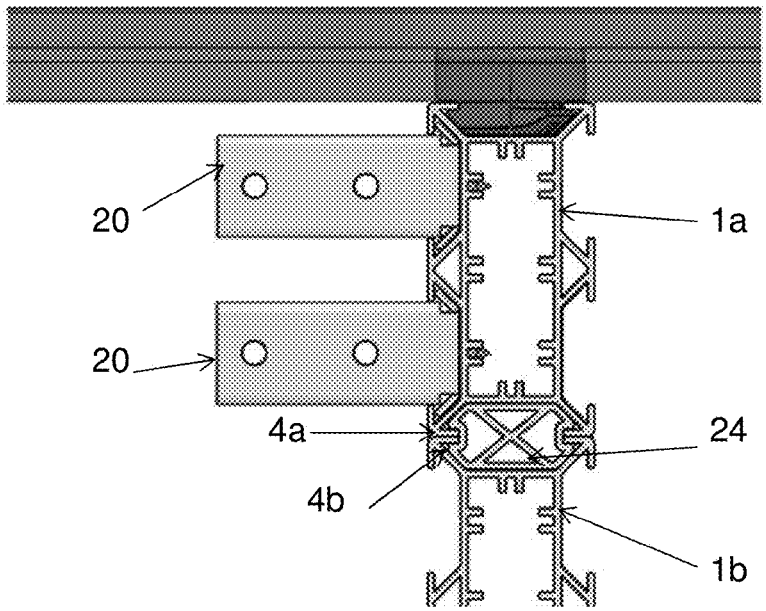
FIG. 12 illustrates a similar arrangement to FIG. 10, but with a further bracket and joist fitted.
Figure 13:
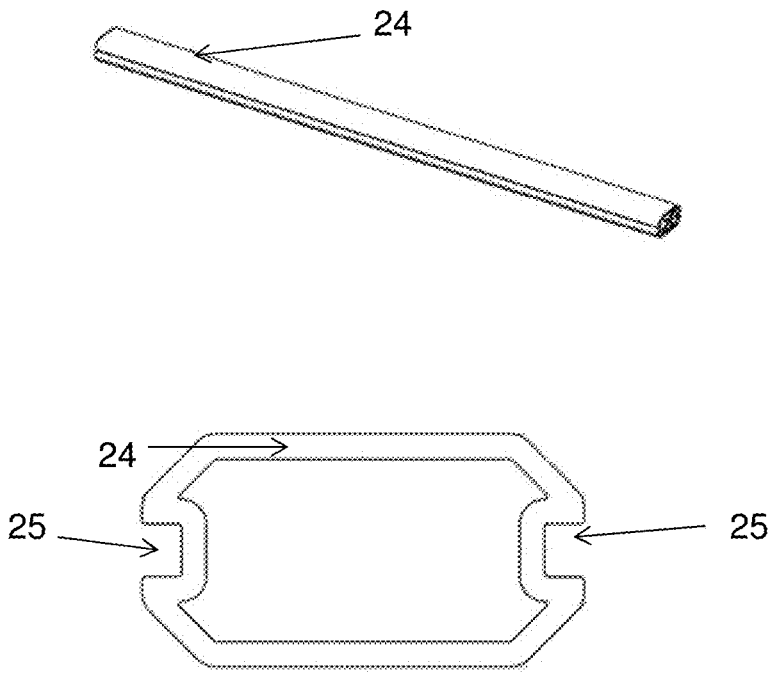
FIG. 13 provides isometric and transverse cross section views of a locking extrusion.

FIG. 12 illustrates the same arrangement as FIG. 10, except that two fixing brackets 20 are fitted to the joist 1*a* and a second identical joist 1*b* is secured beneath the first joist 1*a*. The joists 1*a* and 1*b* are held together by way of a complimentary locking extrusion 24. Referring to FIG. 13, the locking extrusion 24 has grooves 25 extending along its sides and, when in use, each groove receives two flanges 4*a*, 4*b* butted against one another, ie one flange from each of the joists 1*a* and 1*b*.

Figure 14:
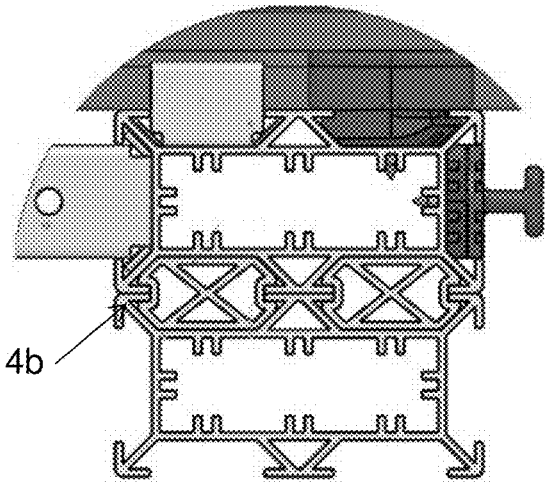
FIG. 14 is a transverse cross section view illustrating a possible configuration of joists as used for the FIG. 12 arrangement.

As will be appreciated, by using a number of joists 1*a*, 1*b* and a number of locking extrusions 24 one can create support structures of various sizes and shapes to suit the job at hand. An example of one possible joist combination is shown at FIG. 14.

The invention is not limited to use in creating a walking surface. The same beam and locking member principle can be used to attach a wide range of parts. In some cases the beam may be a non-structural extrusion and, for example, the locking member may have an outwardly disposed arm for hold an item such as a louvre blade. In some embodiments of the invention the beams may have only a minor supportive function and need not be supportive in the sense of being an important part of the structural integrity of a floor, deck or building generally.

While some embodiments of the invention have been described by way of example it should be appreciated that modifications and improvements can occur without departing from the scope of the following claims.

The invention claimed is:

1. A walking surface having a fastening means comprising a beam and a plastic locking member, the beam having a channel and locking extensions, the locking member having a base and an upstand, the base having a pair of diagonally opposed reduced curved corners and a pair of diagonally opposed corners that are not reduced, the fastening means formed such that when it is in use the base of the locking member can be slid into the channel and rotated in a first direction therein by a quarter turn to assume a locking position, such rotation only made possible by the reduced corners which serve to prevent a rotational impasse between the beam and the locking member, the locking member being such that but for its reduced corners it would clash with side walls of the channel when rotated towards the locking position, the locking member being in tight fit with the channel and unable to pull out of the channel by reason of obstruction by the locking extensions, the locking member being able to be released from the locking position only by rotation of the locking member in a second direction rotationally opposite the first direction, an item of walking surface board arranged such that it has been laid onto one of the locking extensions so that part of the locking member extends into a side groove of the board.

2. The walking surface according to claim 1, wherein a second item of walking surface board is arranged in the same way as the first one but on another of the locking extensions and with a different part of the locking member extending into a side groove of that second item of walking surface board, and wherein the two walking surface boards are in close or butting parallel relationship and have the locking member between them to hold them against the beam.

3. The walking surface according to claim 1, wherein the curved corners of the base of the locking member are generally rounded.

4. The walking surface according to claim 1, wherein the corners of the base of the locking member are generally rounded and/or diagonally opposite one another, and therein the beam comprises a joist, bearer, batten or post.

5. The walking surface according to claim 1, wherein the corners of the base of the locking member are generally rounded and/or diagonally opposite one another, and wherein the locking extensions comprise flanges overhanging the channel.

6. The walking surface according to claim 1, wherein the channel has outwardly angled interior sides.

7. The walking surface according to claim 1, wherein the upstand is generally T shaped in transverse cross section.

8. The walking surface according to claim 1, wherein the base has inwardly tapered sides.

9. The walking surface according to claim 1, wherein the locking member has an aperture suitable for receiving a fixing member to better secure the locking member to the beam.

10. The walking surface according to claim 1, wherein the beam has a plurality of channels and wherein each channel is able to receive a locking member the same, and in the same way, as defined in claim 1.

11. The walking surface according to claim 10, further including an "L" shaped fixing bracket, the base and the upward part of the bracket each having a pair of angled edges, the bracket shaped so that the base can slide into a channel of the beam, the bracket including holes to enable fastening to other building materials.

12. The walking surface according to claim 1, wherein the beam is locked to another beam of the same type by a locking extrusion, the locking extrusion having a groove along each side, a locking extension from each of the beams arranged within one of the grooves, and a different locking extension from each of the beams arranged within a groove on the other side of the locking extrusion.

13. The walking surface according to claim 1, wherein the locking extensions have space between them and the base of the locking member is wider than said space.

14. The walking surface according to claim 1, further including an "L" shaped fixing bracket, the base and the upward part of the bracket each having a pair of angled edges, the bracket shaped so that the base can slide into the channel of the beam, the bracket including holes to enable fastening to other building materials.

15. The walking surface according to claim 1, wherein the pair of diagonally opposed corners of the locking member that are not reduced form a rotational impasse to prevent rotation of the locking member past 90 degrees.

16. The walking surface according to claim 1, wherein the locking position substantially locks the locking member against lateral movement.

17. The walking surface according to claim 1, wherein:

the beam is metallic;

the beam's channel has interior sides angled outwardly at substantially 45 degrees; and the base of the locking member is marginally shorter than the interior width of the channel.

18. The walking surface having a fastening means, comprising a beam in the form of at least one joist, bearer and post, and a plastic locking member, the beam having a channel with outwardly angled interior sides, and locking extensions in the form of flanges extending over the channel, the locking member having a base with a pair of diagonally opposed reduced curved corners and a pair of diagonally opposed corners that are not reduced and an upstand, the base having inwardly tapered sides, the fastening means formed such that when it is in use the base of the locking member can be slid into the channel and rotated in a first direction therein to assume a locking position, such rotation only made possible by the reduced corners which serve to prevent a rotational impasse between the beam and the locking member, the locking member being such that but for its reduced corners it would clash with side walls of the channel when rotated towards the locking position, the locking member being in a tight fit within the channel and cannot pull out of the channel by reason of obstruction by the locking extensions, the locking member being able to be released from the locking position only by rotation of the locking member in a second direction rotationally opposite the first direction, an item of walking surface board arranged such that it has been laid onto one of the locking extensions so that part of the locking member extends into a side groove of the board.

19. The walking surface according to claim 18, wherein the upstand is generally T shaped.

20. The walking surface according to claim 18, wherein:

the beam is metallic;

the beam's channel has interior sides angled outwardly at substantially 45 degrees; and the base of the locking member is marginally shorter than the interior width of the channel.

* * * * *